United States Patent [19]

Lamothe

[11] 4,098,698

[45] Jul. 4, 1978

[54] AUTOMATIC RECOVERY SYSTEM FOR PLUGS AND EXCAVATION MATERIALS

[75] Inventor: André Lamothe, Paris, France

[73] Assignee: Foraco Forage Rationnel Construction, Paris, France

[21] Appl. No.: 724,840

[22] Filed: Sep. 20, 1976

[30] Foreign Application Priority Data

Sep. 19, 1975 [FR] France ..... 75 28798

[51] Int. Cl.[2] ..... B01D 23/06

[52] U.S. Cl. ..... 210/309; 175/60; 175/206; 210/316; 210/448; 210/449; 210/460

[58] Field of Search ..... 210/307–310, 210/316, 409, 448, 449, 460; 175/60, 206–209

[56] References Cited

U.S. PATENT DOCUMENTS 1,645,364 10/1927 Weaver ..... 210/309

3,291,229 11/1963 Houston ..... 175/60

*Primary Examiner*—Frank A. Spear, Jr.

*Assistant Examiner*—Richard W. Burks

*Attorney, Agent, or Firm*—Sughrue, Rothwell, Mion, Zinn and Macpeak

[57] ABSTRACT

The present invention relates to a system for automatically recovering the entirety of the excavated materials in the order in which they are raised to the surface.

The excavated materials being delivered through the central passage of a double pipe system pass into a strainer pipe 6 discharging into a perforated recovery sheath 5 which is closed at its base. A decompression sleeve 3 encloses the strainer pipe. Air and water are evacuated through the strainer slots 6 and all the excavated materials are deposited at 5 in the order in which they are brought up.

The invention is applicable to any reverse circulation drilling system.

3 Claims, 1 Drawing Figure

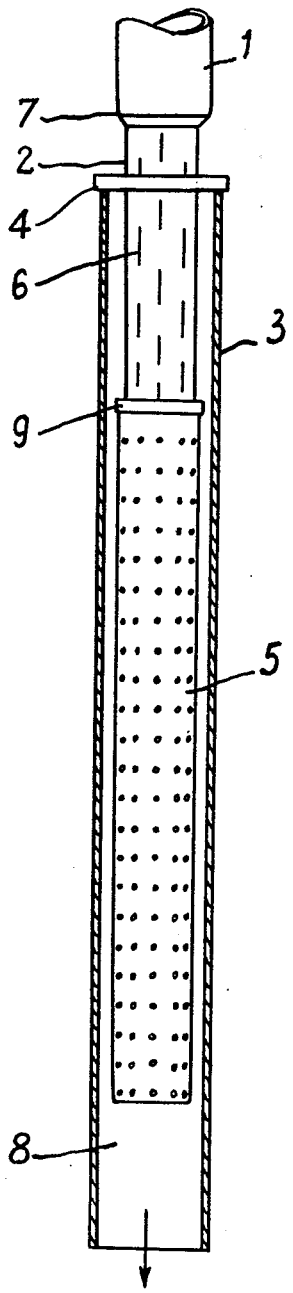
1
7
2
4
6
3
9
5
8

AUTOMATIC RECOVERY SYSTEM FOR PLUGS AND EXCAVATION MATERIALS

BACKGROUND OF THE INVENTION

1. Field of the Invention

The present invention relates to a system for automatically recovering the entirety of the excavated material which is retrieved during a plug removal or drilling operation, more particularly, during reverse circulation drilling using a double piping system.

2. Description of the Prior Art

Methods of bringing plugs of predetermined length to the surface have long been known but the removal of the plugs is often slowed down by the difficulty with which the plug is raised to the surface. One of the least costly methods consists in using compressed air as the drawing means and in retrieving all of the excavated material and drillings by means of separating apparatuses such a cyclones. However, this retrieval method destroys the order in which the excavated material is delivered according to the particular drilling level which has been reached and, furthermore, it has the disadvantage of requiring costly equipment.

SUMMARY OF THE INVENTION

The present invention relates to an automatic system for retrieving the material excavated during drilling or plug removal operations, characterized in that the excavated material is directed towards a strainer pipe enclosed by a decompression sleeve. The strainer pipe discharges into a perforated recovery sheath which is closed at its base.

As a result, whatever the drilling or plug forming method using compressed air as the fluid, the excavated materials are recovered according as they reach the drilling head and they are retrieved in their delivery order without being disturbed. As the strainer pipe is only designed to decompress the circulation air and to remove any water which may have been picked up, the excavated materials fall into the perforated recovery sheath without being disturbed; the perforations facilitating the introduction of the excavated material while maintaining a certain over-pressure facilitating evacuation of the water through the strainer pipe.

Anoher object of the invention is a system of the above-defined type which is further characterized in that the excavated materials are directed exclusively through the central passage of a double piping system regardless of whether a drilling operation or a plug removing operation is being carried out; the compressed air being injected into the annular space surrounding the central passage of the double pipe system.

In this way it is possible to maintain an accurate and continuous geological section; the samples taken during the plug removing operation and all the excavated materials being introduced into the recovery sheath without being soiled in any way as handling is totally avoided.

Other objects, features and advantages of the present invention will be made apparent in the course of the following description of an embodiment of a recovery system which is provided by way of a non-limitative example with reference to the accompanying drawings.

BRIEF DESCRIPTION OF THE DRAWINGS

FIG. 1 shows the entire recovery system in diagrammatic form.

DESCRIPTION OF THE PREFERRED EMBODIMENT

The excavated materials which are brought to the surface by the drilling fluid — generally compressed air — are passed through a pipe 1 of any particular type extending the inner pipe through which the drillings are brought to the surface under the reverse circulation process. A strainer pipe 2 is attached to the pipe 1. The strainer pipe 2 is enclosed by a decompression sleeve 3. This sleeve 3 can be mounted in any desired manner, assuming that it is attached at 4 to the strainer pipe by means of a collar or similar attachment. The sleeve 3, which is open at its lower part 8, can consist of a simple sleeve made of any type of material.

The strainer pipe 2 discharges into a recovery sheath 5 which can also be made of any type of material. This sheath is perforated and closed at its base so as to facilitate the inroduction of the excavated materials and to retain the same. The slight over-pressure produced by the sheath 5 facilitates the evacuation of water which may have been picked up with the excavated materials through the grooves 6 of the strainer pipe 2. As a result, circulation air, water and a certain amount of loose material, which has been ejected through the fine grooves 6 of the strainer pipe 2, are collected at the base of the decompression sleeve 3. The strainer pipe 2 can easily be replaced, for example, by providing a connection of any suitable type at 7. Accordingly, it is possible to select strainer pipes which are suited to the excavated material retrieved so as to prevent excessive dispersion of fine loose materials which may be present under the particular circumstances encountered. If, for some reason, it is wished to recover this small fraction, atomized water can be circulated between the stainer pipe and the sleeve 3; this water agglutinating the fine loose material located between the sleeves. As a result, all the fine, loose materials passing through the grooves 6 are collected at the base 8.

The means for attaching the sheath 5 can obviously consist of any desired means and can be situated, for example, at 9 at the end of the pipe 2. The sheath 5 can be any length and it is obvious that numerous variants could be derived from the above-described system without departing from the scope of the invention. For example, the sheath 5 need not be perforated.

What is claimed is:

1. An automatic recovery system for materials excavated during a drilling or plug removing operation comprising pipe means adapted to be connected to the inner pipe of a two pipe pressurized drilling system for receiving and conveying said materials, a strainer pipe having one end connected to said pipe means having a plurality of relatively fine slots disposed about the circumference thereof through which the pressurizing medium may be dissipated, a recovery sheath having a closed end and an open end connected to the other end of said strainer pipe for receiving and holding said materials and a sleeve open at at least one end secured to said strainer pipe and disposed in radially outwardly spaced concentric relation to said strainer pipe and said sheath for limiting the dissipation of the pressurizing medium and collecting fine loose material which may have passed through said slots.

2. An automatic recovery system as set forth in claim 1, wherein said strainer pipe is connected to said pipe means and said sheath by disengageable connecting means to provide for the interchangeability of strainer pipes having different size slots therein.

3. An automatic recovery system as set forth in claim 1, wherein said recovery sheath is provided with a plurality of perforations.

* * * * *